US005617728A

United States Patent [19]

Kim et al.

[11] Patent Number: 5,617,728

[45] Date of Patent: Apr. 8, 1997

[54] ICE REMOVAL DEVICE FOR USE IN AN ICE MAKER AND METHOD FOR CONTROLLING SAME

[75] Inventors: Chong-Sun Kim, Kyongki-do; Ji-Kwang Jung, In-Cheon, both of Rep. of Korea

[73] Assignee: Daewoo Electronics Co., Ltd., Seoul, Rep. of Korea

[21] Appl. No.: 562,926

[22] Filed: Nov. 27, 1995

[30] Foreign Application Priority Data

Nov. 29, 1994 [KR] Rep. of Korea ..... 94-31794
Nov. 29, 1994 [KR] Rep. of Korea ..... 94-31796

[51] Int. Cl.[6] ..... F25C 5/04

[52] U.S. Cl. ..... 62/71; 62/353

[58] Field of Search ..... 62/71, 72, 353

[56] References Cited

U.S. PATENT DOCUMENTS

| | | | |
|---|---|---|---|
| 3,308,631 | 3/1967 | Kniffin | 62/353 |
| 3,362,181 | 1/1968 | Linstromberg | 62/353 |
| 3,382,682 | 5/1968 | Frohbieter | 62/353 |
| 3,540,227 | 11/1970 | Eyman, Jr. et al. | 62/353 |
| 3,745,779 | 7/1973 | Bright | 62/353 |
| 3,775,992 | 12/1973 | Bright | 62/353 |
| 4,332,146 | 6/1982 | Yamazaki et al. | 62/353 |
| 4,402,194 | 9/1983 | Kuwako et al. | 62/353 |
| 5,400,605 | 3/1995 | Jeong | 62/353 |
| 5,425,243 | 6/1995 | Sanuki et al. | 62/353 |

*Primary Examiner*—William E. Tapolcai
*Attorney, Agent, or Firm*—Pennie & Edmonds

[57] ABSTRACT

An ice removal device for use in an ice maker comprises a driving motor; a cam gear; a cam provided with a smaller and a larger circular portions with concentrical circumferential surfaces, respectively; a plurality of gears; and a rotation reversing sensor having a knob switch. The rotation reversing sensor is disposed adjacent to the cam in such a way that the knob switch is pressed by either one of edges of the circumferential surface of the larger circular portion of the cam at a time.

6 Claims, 9 Drawing Sheets

ICE REMOVAL DEVICE FOR USE IN AN ICE MAKER AND METHOD FOR CONTROLLING SAME

FIELD OF THE INVENTION

The present invention relates to an ice maker; and, more particularly, to an ice removal device for use in the ice maker having a reduced number of components and a method for controlling same.

DESCRIPTION OF THE PRIOR ART

As shown in FIG. 1A, an ice maker for use in a refrigerator normally comprises an ice manufacturing unit 20, a temperature sensor 21 for sensing the temperature of the ice manufacturing unit 20, a driving motor 10 for rotating the unit 20, a rotation reversing switch 22 for changing the rotational direction of the driving motor 10, an ice box 30 for receiving ice cubes falling from the unit 20, a sensor 33 provided with a sensing member 34 for detecting whether or not the ice box 30 is fully filled, a water tank 40, a water reservoir 42, a water supplying hose 44, and a pumping motor 41.

The pumping motor 41 supplies water from the water reservoir 42 to the ice manufacturing unit 20 through the water supplying hose 44.

There is shown in FIG. 1B a perspective view of the ice manufacturing unit 20 and a supporting member 25. The unit 20 and the supporting member 25 are provided with a protrusion 27 and a restrainer 26, respectively, in such a way that the rotation of the protrusion 27, and hence the unit 20 is limited by the restrainer 26.

There is shown in FIG. 2A a conventional ice removal device for use in the automatic ice maker. The conventional ice removal device 100 includes a driving motor 10, a plurality of (e.g., five) gears 11 to 15, a cam gear 60, a cam 50 having an upper and a lower faces 51, 52 and a circumferential surface 53, a pair of stoppers 61, a normal position sensor 23 having a knob, a rotation reversing switch 22 having a knob, an actuator 70, and a base 90.

The driving motor 10 rotates the cam gear 60 through the plurality of gears 11 to 15 either clockwise or counterclockwise.

The cam gear 60 and the cam 50 are, in turn, secured on one end of the shaft 20' of the ice manufacturing unit 20 (see FIG. 2B), so that they can rotate integrally in response to the rotation of the driving motor 10.

The pair of stoppers 61 protruding from the base 90 and facing each other are spaced out by a desired distance from the circumferential surface 53 of the cam 50.

The actuator 70 includes a pair of wings 71, 72 resiliently coupled together via a spring member (not shown), one wing 71 disposed between the pair of stoppers 61 in such a way that one end thereof optionally contacts with either one of the edges of the upper face 51 of the cam 50 at a time and the other wing 72 disposed to press the knob of the rotation reversing switch 22. The remaining ends of the wings 71, 72 are held by a shaft 73 so that the pair of wings 71, 72 extend in opposite directions from each other.

The normal position sensor 23 is so disposed that the knob thereof is pressed by the circumferential surface of the lower face 52 of the cam 50.

FIG. 2B is a cross sectional view taken along a line I—I of FIG. 2A, showing the upper and the lower faces 51, 52 of the cam 50 in detail.

There is shown in FIG. 3 another conventional ice removal device 200. Such an ice removal device 200 is similar to the above-mentioned device 100 except for the shape of a cam 150 and an actuator 170 used therein.

The cam 150 is provided with a smaller circular portion 151 and a larger circular portion 152, the larger circular portion 152 having a pair of contact faces 161.

The actuator 170 includes a pair of wings 171, 172 resiliently coupled together via a spring member (not shown), one wing 171 disposed between the pair of contact faces 161 in such a way that one end thereof optionally contacts with either one of the pair of contact faces 161 of the cam 150 at a time and the other wing 172 disposed so that one end thereof may press the knob of the rotation reversing switch 22. The remaining ends of the wings 171, 172 are held by a shaft 173 so that the pair of wings 171, 172 extend in opposite directions from each other. Furthermore, a pair of protrusions (not shown) formed on the bottom surfaces of the wings 171, 172 are fitted into a pair of the guide slots 174, 175 formed on the base 190, respectively. The movement of the wings 171, 172 are, therefore, restricted by the guide slots 174, 175, respectively.

Such conventional ice removal devices 100, 200 include many components, resulting in a poor productivity at an increased manufacturing cost. Furthermore, since the rotation of the driving motor, and hence the ice manufacturing unit, is controlled through the actuator, the operating process thereof and the configuration of the cam are complicated, thereby increasing the possibility of malfunctioning thereof.

SUMMARY OF THE INVENTION

It is, therefore, a primary object of the present invention to provide an improved ice removal device for use in an ice maker having a reduced number of components, thereby facilitating the assembly thereof and reducing the likelihood of malfunctioning, and a method for controlling thereof.

In accordance with one aspect of the present invention, there is provided an ice removal device for use in an ice maker having a controller and an ice manufacturing unit with a shaft, the device comprising: a driving motor; a cam gear secured on one end of the shaft of the unit; a plurality of gears for transmitting the rotational force of the driving motor to the cam gear; a cam secured on the end of the shaft of the unit in such a way that the cam gear is interposed therebetween, the cam provided with a smaller and a larger circular portions with concentrical circumferential surfaces, respectively, the circumferential surface of the larger circular portion having a pair of edges; and a rotation reversing sensor having a knob switch, the sensor disposed adjacent to the cam in such a way that the knob switch is optionally pressed by either one of the edges of the circumferential surface of the larger circular portion of the cam at a time.

In accordance with another aspect of the present invention, there is provided a method for controlling an ice removal device for use in an ice maker having a controller and an ice manufacturing unit with a shaft, the ice removal device including a driving motor, a cam gear and a cam secured on the shaft of the ice manufacturing unit, a plurality of gears for transmitting the rotational force of the driving motor to the cam gear, and a rotation reversing sensor having a knob switch, the method comprising the steps of:

A. rotating the cam and the ice manufacturing unit in a first direction;

B. checking whether or not the rotation reversing sensor is activated, wherein, if the sensor is determined to be activated, step B proceeds to step C, but if not, returns to step A;

C. rotating the cam and the ice manufacturing unit in a second direction;

D. checking whether or not the rotation reversing sensor is deactivated, wherein, if the sensor is determined to be deactivated, step D proceeds to step E, but if not, returns to step C;

E. continuously rotating the cam and the ice manufacturing unit in the second direction;

F. checking whether or not the rotation reversing sensor is activated, wherein, if the sensor is determined to be activated, step F proceeds to step G, but if not, returns to step E;

G. rotating the cam and the ice manufacturing unit in the first direction;

H. checking whether or not the rotation reversing sensor is deactivated, wherein, if the sensor is determined to be deactivated, step H proceeds to step I, but if not, returns to step G; and I. stopping the driving motor after a predetermined time has elapsed.

BRIEF DESCRIPTION OF THE DRAWINGS

The above and other objects and features of the present invention will become apparent from the following description of preferred embodiments, when taken in conjunction with the accompanying drawings, in which.

DETAILED DESCRIPTION OF THE PREFERRED EMBODIMENT

Figure 1A:
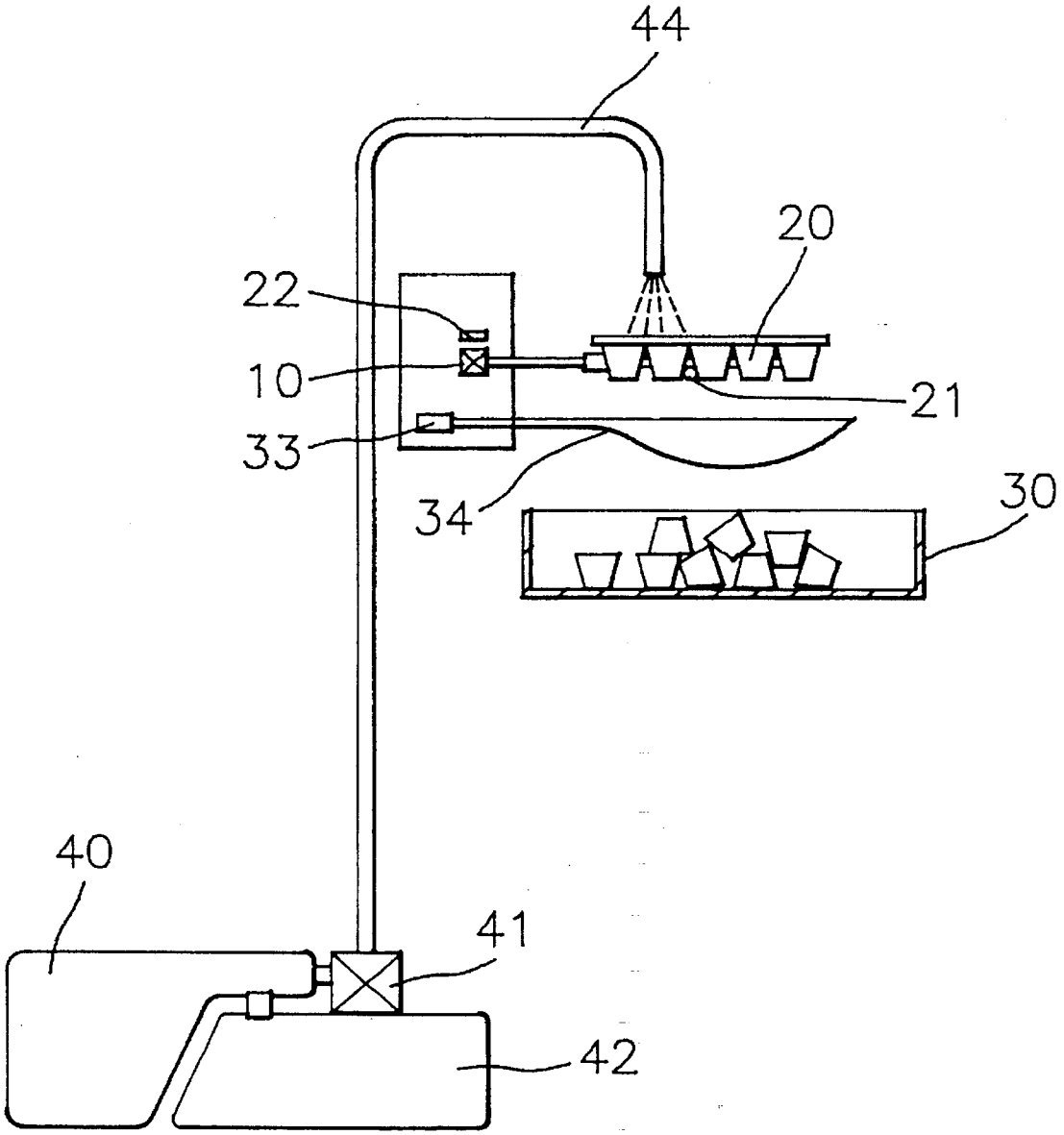
FIG. 1A (PRIOR ART)
FIG. 1A presents a schematic view of a conventional ice maker for use in a refrigerator.
Figure 1B:
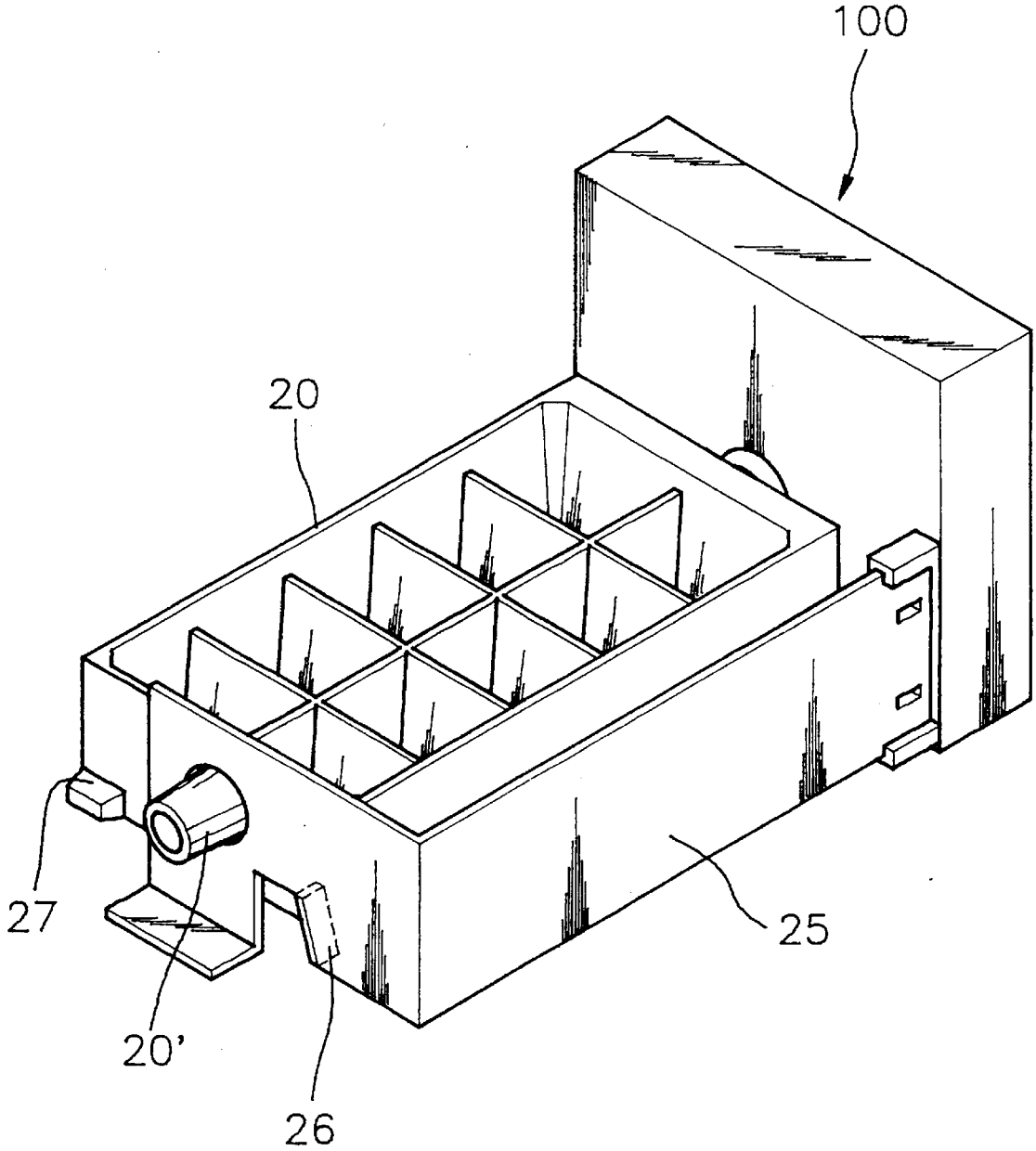
FIG. 1B (PRIOR ART)
FIG. 1B shows a perspective view of an ice manufacturing unit and a supporting member.
Figure 2A:
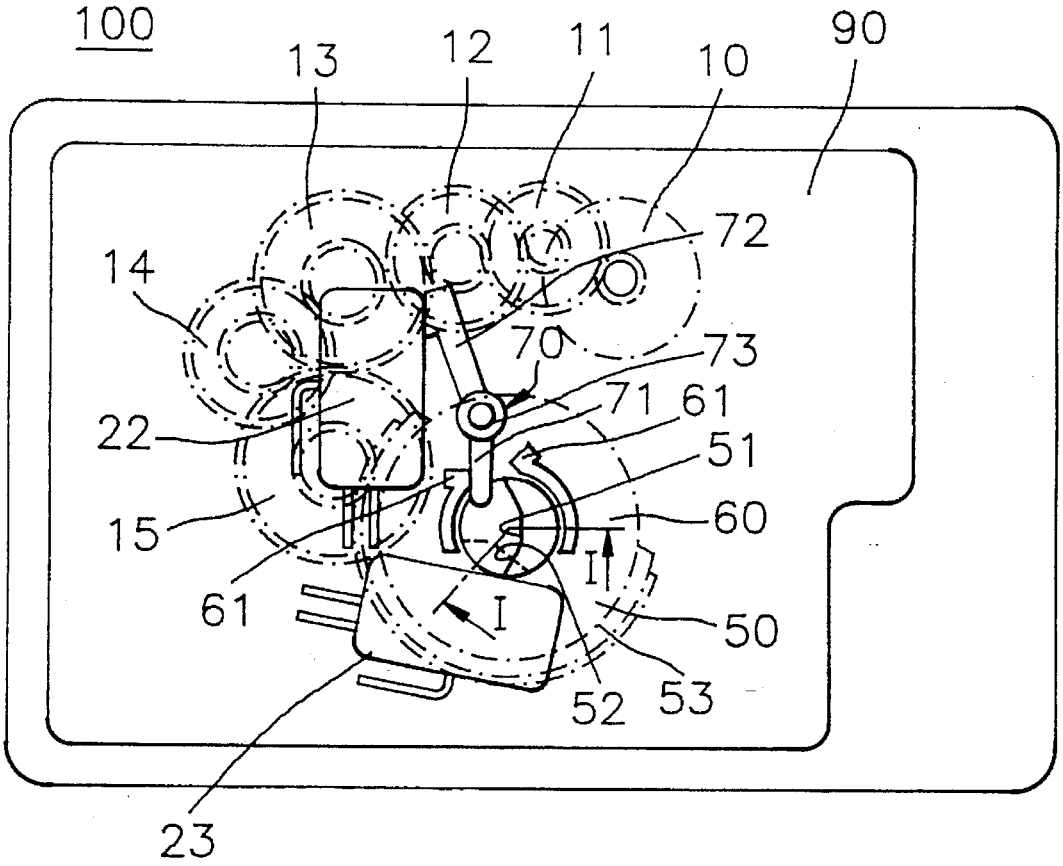
FIG. 2A (PRIOR ART)
FIG. 2A depicts a schematic view of a conventional ice removal device for use in the ice maker, showing an arrangement of the components therein.
Figure 2B:
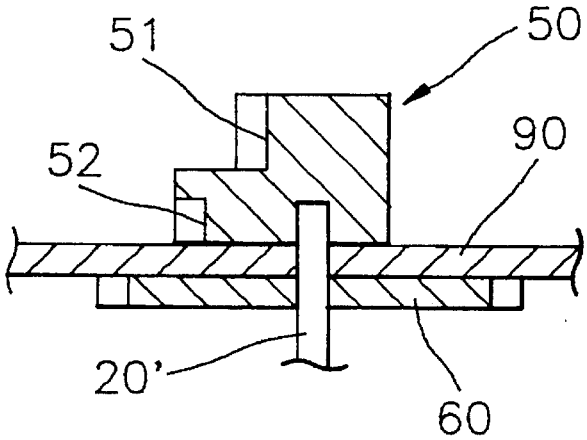
FIG. 2B (PRIOR ART)
FIG. 2B provides a cross-sectional view taken along a line I—I of FIG. 2A.
Figure 3:
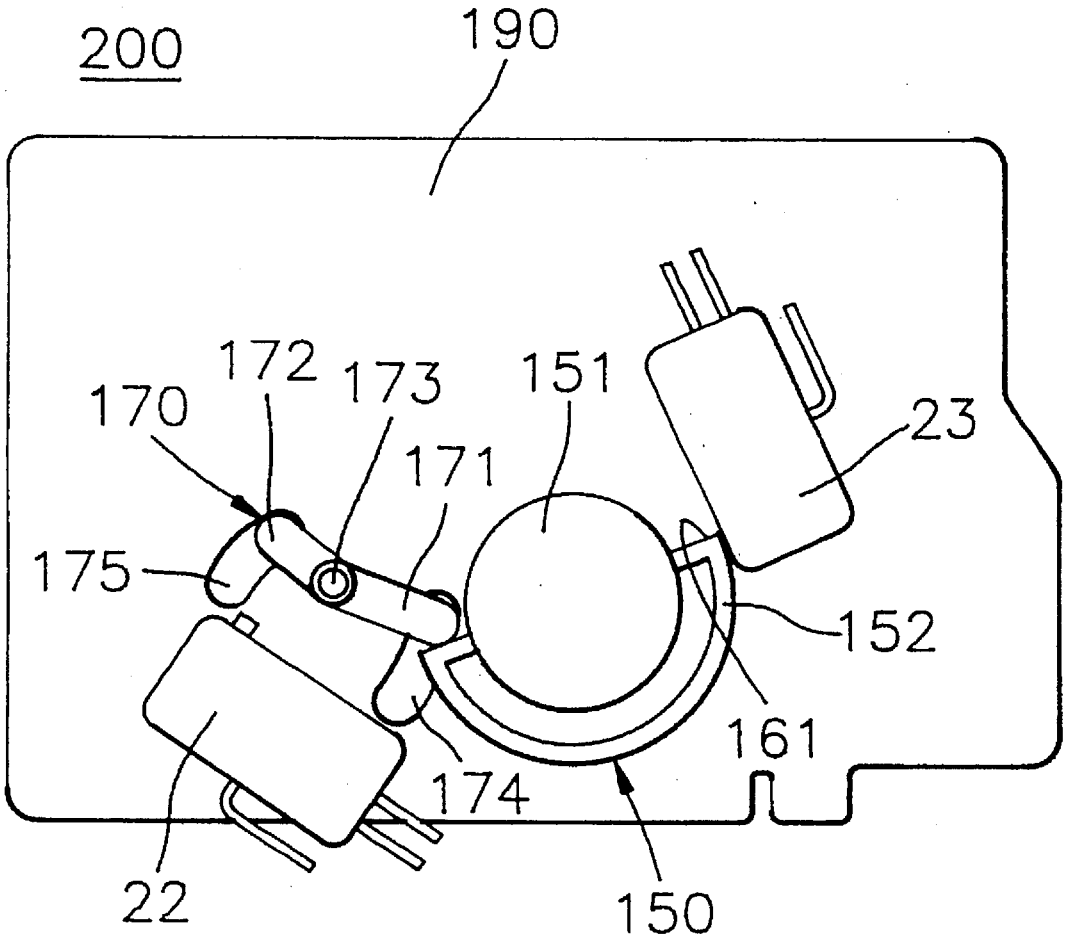
FIG. 3 (PRIOR ART)
FIG. 3 offers a schematic view of another conventional ice removal device for use in the ice maker, showing an arrangement of the components therein.
Figure 4:
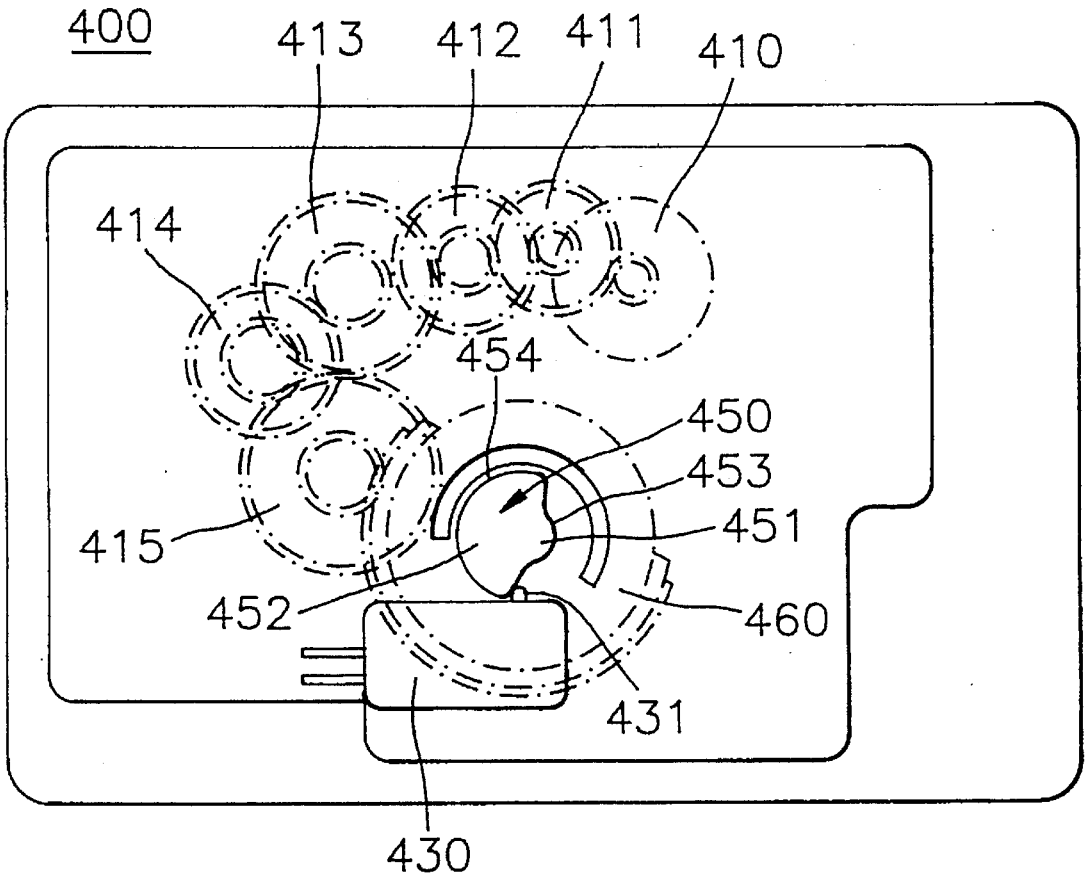
FIG. 4 represents a schematic view of an inventive ice removal device in accordance of the present invention, showing an arrangement of the components therein.

There is shown in FIG. 4 a schematic view of a preferred embodiment of an inventive ice removal device 400 for use in an automatic ice maker having a controller (not shown), e.g., a micro computer, an ice manufacturing unit 20 with a shaft 20' and a supporting member 25 (see FIGS. 1A and 1B).

The inventive ice removal device 400 includes a driving motor 410, a cam gear 460, a plurality of (e.g., five) gears, 411 to 415, a cam 450, and a rotation reversing sensor 430 having a knob switch 431.

The plurality of gears, 411 to 415, are arranged between the driving motor 410 and the cam gear 460 in such a way that the first and the last gears 411, 415 are engaged with the driving motor 410 and the cam gear 460, respectively, thereby transmitting the rotational force of the driving motor 410 to the cam gear 460.

The cam 450 is provided with a smaller and a larger circular portions 451 and 452 with concentrical circumferential surfaces 453 and 454, respectively. The circumferential surface 454 has a pair of edges, and an opening angle Θ thereof (see FIG. 5A) is preferably less than or equal to 202 degrees.

The cam gear 460 and the cam 450 are, in turn, secured on one end of the shaft 20' of the ice manufacturing unit 20 so that they rotate integrally in response to the rotation of the driving motor 410.

The rotation reversing sensor 430 is disposed adjacent to the cam 450 in such a way that the knob switch 431 is optionally pressed by either one of the edges of the circumferential surface 454 of the larger circular portion 452 of the cam 450 at a time.

The controller incorporated in the ice maker receives a series of signals from the sensor 430 and controls the rotation of the driving motor 410.

With reference to FIGS. 5A to 5D, operation of the cam 450 and the rotation reversing sensor 430 of the ice removal device of the present invention will now be described.

Figure 5A:
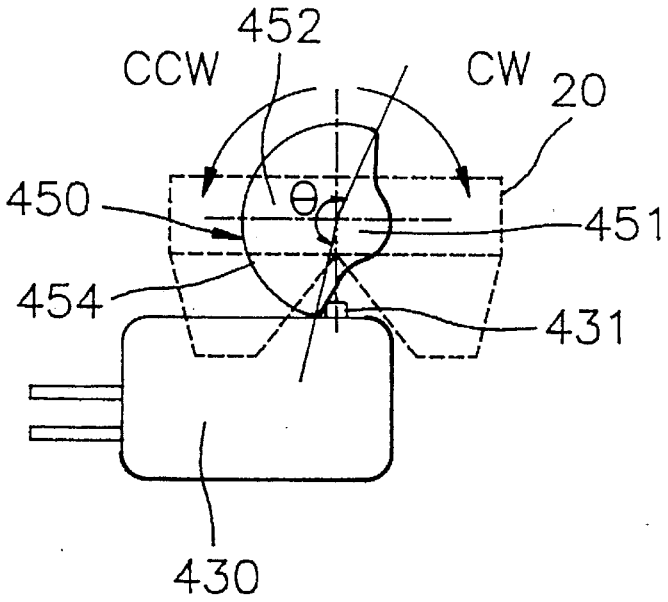
FIGS. 5A to 5D illustrate relative positions of a cam with respect to a rotation reversing sensor of the inventive ice removal device shown in FIG. 4 at different operational stages, respectively.

FIG. 5A represents an initial position of the cam 450 with respect to the rotation reversing sensor 430.

In the ice maker, when an ice manufacturing process is completed, the controller starts to integrally rotate the cam 450 and the ice manufacturing unit 20 clockwise by rotating the driving motor 410 in one direction, e.g., clockwise.

Figure 5B:
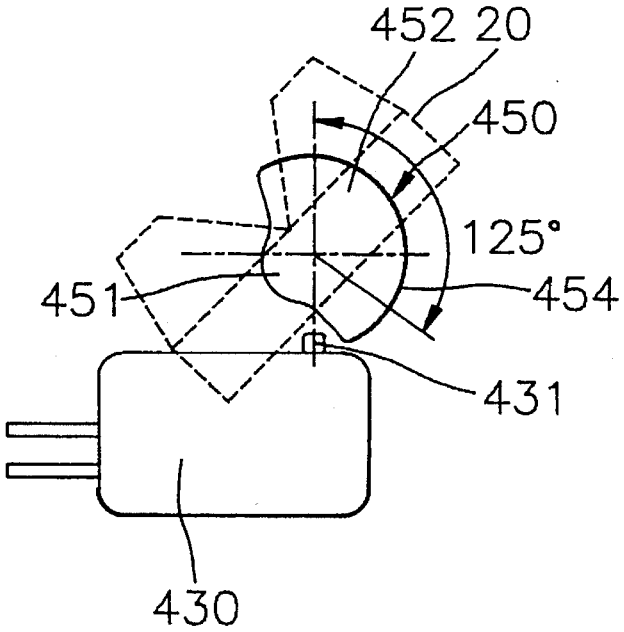

As shown in FIG. 5B, when the cam 450 and the ice manufacturing unit 20 rotate clockwise by a predetermined angle, e.g., 125 degrees, a protrusion 27 of the ice manufacturing unit 20 is stopped by a restrainer 26 of the supporting member 25, as mentioned before, and the ice manufacturing unit cannot rotate any further. Therefore, when the cam 450 is forced to further rotate, the ice manufacturing unit 20 is subjected to a distortion, making the ice cubes therein fall into an ice box 30 disposed below the ice manufacturing unit 20 (see FIG. 1A).

Figure 5C:
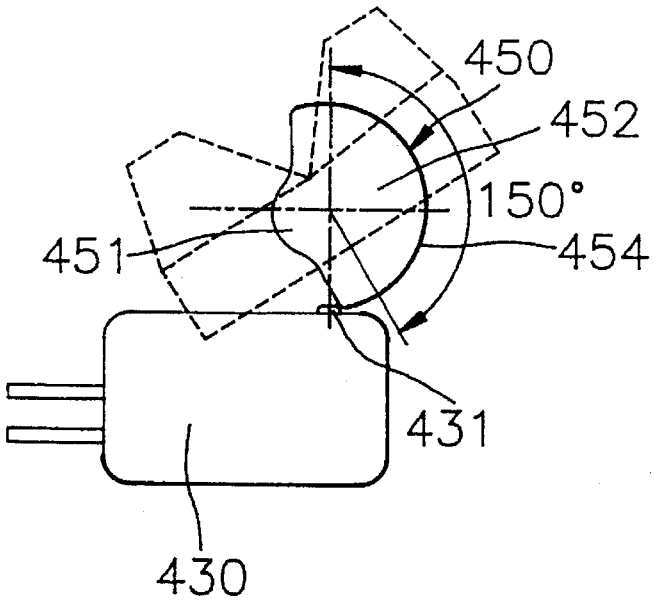

If the cam 450 is forced to further rotate clockwise by, e.g., 25 degrees, and if one edge of the circumferential surface 454 of the larger circular portion 452 of the cam 450 comes to press the knob switch 431 of the rotation reversing sensor 430, as shown in FIG. 5C, the controller reverses the rotational direction of the driving motor 410, which, in turn, will start to rotate the cam 450 and the ice manufacturing unit 20 counterclockwise. As soon as the cam 450 begins to rotate counterclockwise, the knob switch 431 will be released, while the driving motor 410 continues to rotate in the reversed direction.

Figure 5D:
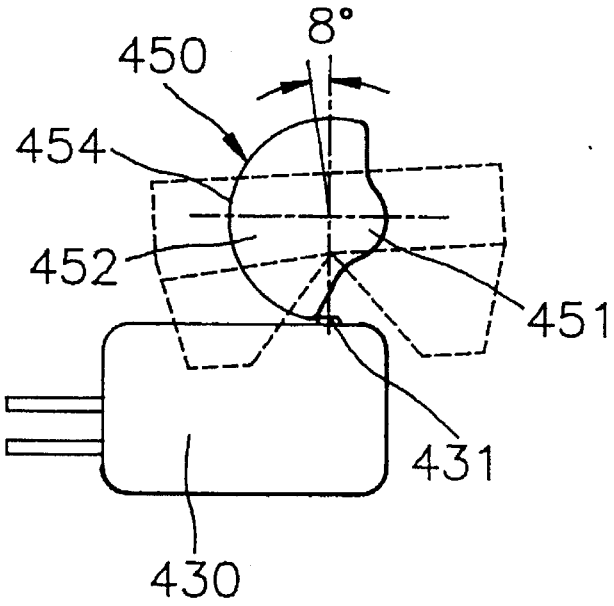

As shown in FIG. 5D, if the other edge of the larger circular portion 452 of the cam 450 presses the knob switch 431 of the rotation reversing sensor 430, the controller reverses the rotational direction of the driving motor 410 again, rotating the cam 450 and the ice manufacturing unit 20 clockwise. The controller then stops the driving motor 410 after a further rotation by a predetermined degree, e.g., 8 degrees, or when the cam 450 and the ice manufacturing unit 20 are restored to the initial position.

Such an ice removal device 400 in accordance with the present invention can be assembled more easily than a conventional one owing to a reduced number of components therein, and decrease the possibility of malfunctioning thereof.

Figure 6A:
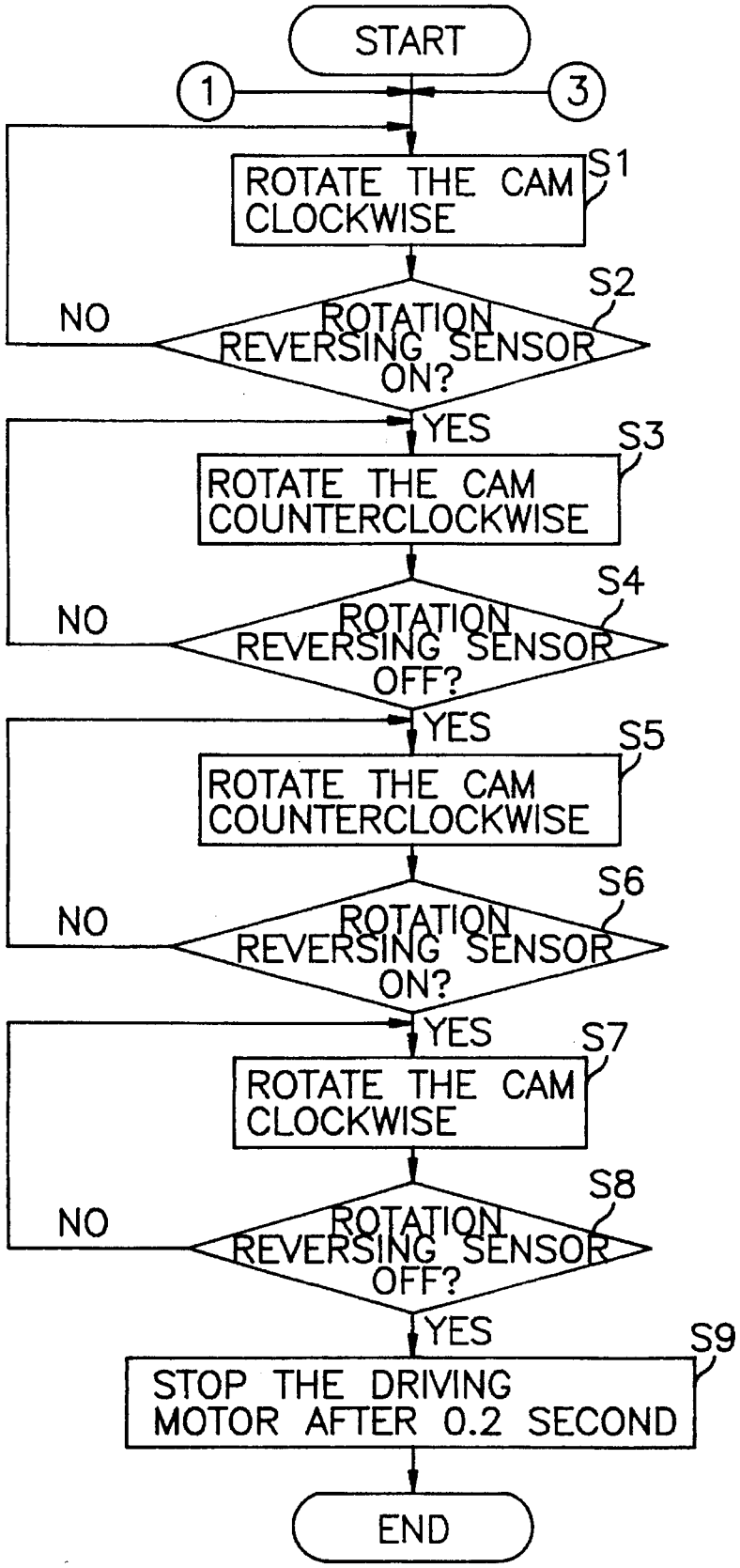
FIGS. 6A and 6B describe flow charts illustrating a process for controlling the inventive ice removal device shown in FIG. 4.
Figure 6B:
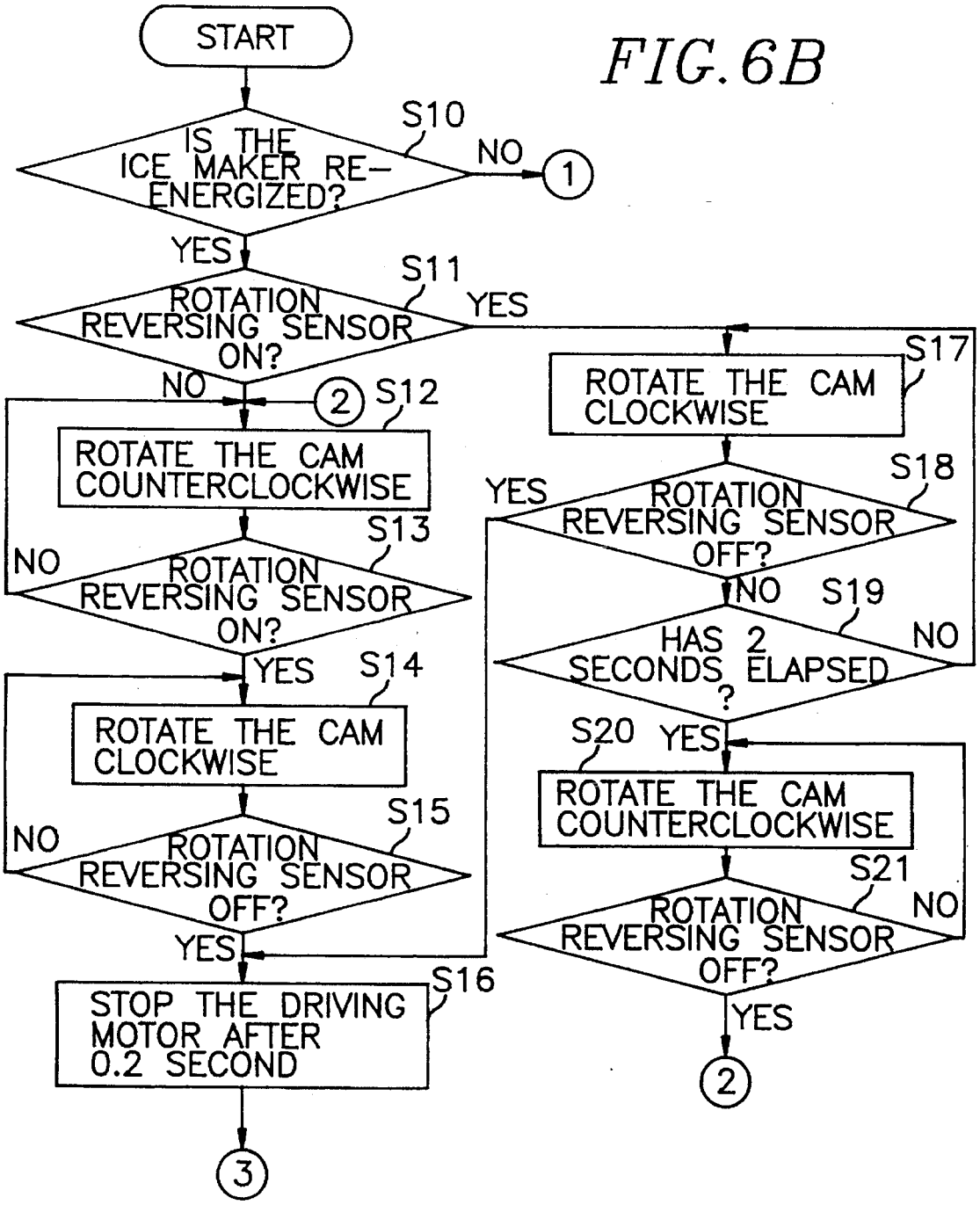

There are shown in FIGS. 6A and 6B flow charts illustrating a process for controlling the ice removal device 400 in accordance with the present invention.

In step 1 of the controlling process, when an ice manufacturing process is completed, the controller rotates the driving motor 410 in one direction, e.g., clockwise, in order to rotate the cam 450 and the ice manufacturing unit 20 clockwise.

At step 2, the controller checks whether or not the rotation reversing sensor 430 is activated. The rotation reversing sensor 430 is activated by one edge of the circumferential surface 454 of the larger circular portion of the cam 450 pressing the knob switch 431 thereof, as shown in FIG. 5C. If it is determined that the sensor 430 is activated, the process proceeds to step 3, wherein the controller rotates the cam 450 and the ice manufacturing unit 20 counterclockwise by reversing the rotational direction of the driving motor 410. In step 4, the controller checks whether or not the rotation reversing sensor 430 is deactivated, i.e., checks whether or not the knob switch 431 thereof is released. If the sensor 430 is determined to be deactivated, the process proceeds to step 5, wherein the controller continues to rotate the cam 450 and the ice manufacturing unit 20, but if not, returns to step 3.

In step 6, the controller checks again whether or not the rotation reversing sensor 430 is activated. As shown in FIG. 5D, the sensor 430 is activated by the other edge of the larger circular portion 452 of the cam 450 pressing the knob switch 431 thereof. If the rotation reversing sensor 430 is determined to be activated, the process proceeds to step 7, wherein the controller rotates the cam 450 and the ice manufacturing unit 20 clockwise again by reversing the rotational direction of the driving motor 410. If not, however, the process returns to step 5.

Finally, the process proceeds to step 8, wherein the controller checks whether or not the sensor 430 is deactivated. If the rotation reversing sensor 430 is determined to be deactivated, the process goes to step 9, wherein the controller stops the driving motor 410 after a predetermined time, e.g., 0.2 second, has elapsed. However, if not, the process returns to step 7.

On the other hand, if the automatic ice maker is re-energized after an electric power thereto has been cut-off, the ice manufacturing unit 20 must be reset in the initial position. Therefore, as shown in FIG. 6B, it is preferable to first check whether or not the ice maker is re-energized step 10) prior to step 1. If it is determined that the ice maker has been re-energized, the process proceeds to step 11 to reset the unit 20, but if not, the process proceeds to step 1 and performs the ice removing process shown in FIG. 6A.

In step 11, the controller checks whether or not the rotation reversing sensor 430 is activated, and if the sensor 430 is determined to be activated, the process goes to step 17, but if not, the process proceeds to step 12, wherein the controller rotates the cam 450 counterclockwise by rotating the driving motor 410 in another direction, e.g., counterclockwise.

In step 13, the controller checks again whether or not the rotation reversing sensor 430 is activated. If the sensor 430 is determined to be activated, the process proceeds to step 14, but if not, the process returns to step 12.

In step 14, the controller rotates the cam 450 clockwise by reversing the rotational direction of the driving motor 410. At step 15, the controller checks whether or not the rotation reversing sensor 430 is deactivated. If the sensor 430 is determined to be deactivated, the process goes to step 16 and the controller stops the driving motor 410 after a predetermined time, e.g., 0.2 second has elapsed, but if not, the process returns to step 14. Then, the process proceeds to step 1 and performs the ice removing process S1 to S9.

On the other hand, in step 17, the controller rotates the cam 450 clockwise by rotating the driving motor 410 clockwise. In step 18, the controller checks whether or not the rotation reversing sensor 430 is deactivated. If the sensor 430 is determined to be deactivated, the process returns to step 16, but if not, the process proceeds to step 19, wherein the controller checks whether or not a predetermined time, e.g., 2 seconds, has elapsed after, in step 17, the cam 450 began to rotate clockwise. In step 19, if it is determined that the predetermined time has elapsed, the process proceeds to step 20, but if not, returns to step 17.

In step 20, the controller rotates the cam 450 counterclockwise by reversing the rotational direction of the driving motor 410. In step 21, the controller checks whether or not the sensor 430 is deactivated, and if the sensor 430 is determined to be deactivated, the process proceeds to step 16, but if not, returns to step 20.

Although the invention has been shown and described with respect to the preferred embodiments, it will be understood by those skilled in the art that various changes and modifications may be made without departing from the spirit and scope of the invention as defined in the following claims.

What is claimed is:

1. An ice removal device for use in an ice maker including a controller and an ice manufacturing unit having a shaft, the device comprising:

a driving motor;

a cam gear secured on one end of the shaft of the unit;

a plurality of gears for transmitting the rotational force of the driving motor to the cam gear;

a cam secured on the end of the shaft of the ice manufacturing unit in such a way that the cam gear is interposed therebetween, the cam provided with a smaller and a larger circular portions with concentrical circumferential surfaces, respectively, the circumferential surface of the larger portion having a pair of edges; and a rotation reversing sensor having a knob switch, the sensor disposed adjacent to the cam in such a way that the knob switch is optionally pressed by either one of the edges of the circumferential surface of the larger circular portion of the cam at a time.

2. The device of claim 1, wherein an opening angle of the circumferential surface of the larger circular portion of the cam is less than or equal to 202 degrees.

3. The device of claim 1, wherein the rotation reversing sensor sends a series of signals to the controller, and rotational directions of the driving motor, the cam gear, the cam and the ice manufacturing unit are controlled in response to the signals by the controller.

4. An ice maker comprising the ice removal device as recited in any one of claims 1 to 3.

5. A method for controlling an ice removal device for use in an ice maker including a controller and an ice manufacturing unit having a shaft, the ice removal device including a driving motor, a cam gear, a cam secured on the shaft of the ice manufacturing unit, a plurality of gears for transmitting thee rotational force of the driving motor to the cam gear, and a rotation reversing sensor having a knob switch, the method comprising the steps of:

A. rotating the cam and the ice manufacturing unit in a first direction;

B. checking whether or not the rotation reversing sensor is activated, wherein, if the sensor is determined to be activated, step B proceeds to step C, but if not, returns to step A;

C. rotating the cam and the ice manufacturing unit in a second direction;

D. checking whether or not the rotation reversing sensor is deactivated, wherein, if the sensor is determined to be deactivated, step D proceeds to step E, but if not, returns to step C;

E. continuously rotating the cam and the ice manufacturing unit in the second direction;

F. checking whether or not the rotation reversing sensor is activated, wherein, if the sensor is determined to be activated, step F proceeds to step G, but if not, returns to step E;

G. rotating the cam and the ice manufacturing unit in the first direction;

H. checking whether or not the rotation reversing sensor is deactivated, wherein, if the sensor is determined to be deactivated, step H proceeds to step I, but if not, returns to step G; and I. stopping the driving motor after a predetermined time has elapsed.

6. The method of claim 5, further comprising, prior to the step A, the steps of:

a. checking whether or not the ice maker is re-energized, wherein, if the ice maker is determined to be re-energized, step a proceeds to step b, but if not, proceeds to step A;

b. checking whether or not the rotation reversing sensor is activated, wherein, if the sensor is determined to be activated, step b proceeds to step g, but if not, proceeds to step c;

c. rotating the cam and the unit in the second direction;

d. checking whether or not the rotation reversing sensor is activated, wherein, if the sensor is determined to be activated, step d proceeds to step e, but if not, returns to step c;

e. rotating the cam and the unit in the first direction;

f. checking whether or not the rotation reversing sensor is deactivated, wherein, if the sensor is determined to be deactivated, step f proceeds to step l, but if not, returns to step e;

g. rotating the cam and the unit in the first direction;

h. checking whether or not the sensor is deactivated, wherein, if the sensor is determined to be deactivated, step h proceeds to step l, but if not, proceeds to step i;

i. checking whether or not a predetermined time has elapsed, wherein, if it is determined that the predetermined time has elapsed, step i proceeds to step j, but if not, returns to step g;

j. rotating the cam and the unit in the second direction;

k. checking whether or not the sensor is deactivated, wherein, if the sensor is determined to be deactivated, step k proceeds to step c, but if not, returns to step j; and l. stopping the driving motor after a predetermined time has elapsed.

* * * * *